US011355846B2

(12) United States Patent
Wen et al.

(10) Patent No.: US 11,355,846 B2
(45) Date of Patent: Jun. 7, 2022

(54) SINGLE ANTENNA STRUCTURE CAPABLE OF OPERATING IN MULTIPLE BAND WIDTHS

(71) Applicants: Futaijing Precision Electronics (Yantai) Co., Ltd., Yantai (CN); FIH (HONG KONG) LIMITED, Kowloon (HK)

(72) Inventors: Hsiang-Neng Wen, New Taipei (TW); Chi-Sheng Liu, New Taipei (TW); Yung-Yu Tai, New Taipei (TW); Ching-Ling Wu, New Taipei (TW)

(73) Assignees: Futaijing Precision Electronics (Yantai) Co., Ltd., Yantai (CN); FIH (HONG KONG) LIMITED, Kowloon (HK)

( * ) Notice: Subject to any disclaimer, the term of this patent is extended or adjusted under 35 U.S.C. 154(b) by 0 days.

(21) Appl. No.: 17/105,958

(22) Filed: Nov. 27, 2020

(65) Prior Publication Data

US 2022/0021116 A1 Jan. 20, 2022

(30) Foreign Application Priority Data

Jul. 14, 2020 (CN) ..... 202010676482.8

(51) Int. Cl.

| | |
|---|---|
| ***H01Q 5/364*** | (2015.01) |
| ***H01Q 9/42*** | (2006.01) |
| ***H01Q 1/48*** | (2006.01) |
| ***H01Q 1/24*** | (2006.01) |

(52) U.S. Cl.

CPC ..... *H01Q 5/364* (2015.01); *H01Q 1/241* (2013.01); *H01Q 1/48* (2013.01); *H01Q 9/42* (2013.01)

(58) Field of Classification Search

CPC .... H01Q 5/364; H01Q 5/371; H01Q 9/40–42; H01Q 9/0421

See application file for complete search history.

(56) References Cited

U.S. PATENT DOCUMENTS

| | | | | |
|---|---|---|---|---|
| 5,146,232 A * | 9/1992 | Nishikawa | ..... | H01Q 1/32 343/713 |
| 6,445,358 B2 * | 9/2002 | Takahashi | ..... | H01Q 5/371 343/702 |
| 7,202,826 B2 * | 4/2007 | Grant | ..... | H01Q 1/3275 343/700 MS |
| 2008/0284661 A1 | 11/2008 | He | | |

FOREIGN PATENT DOCUMENTS

| | | | | |
|---|---|---|---|---|
| EP | 1681742 B1 * | 12/2008 | ..... | H01Q 9/0414 |

* cited by examiner

*Primary Examiner* — Ricardo I Magallanes
(74) *Attorney, Agent, or Firm* — ScienBiziP, P.C.

(57) ABSTRACT

An antenna structure with wide radiation bandwidth includes a first radiation portion, a ground portion, a connection portion, a second radiation portion, and a feed portion. The ground portion is positioned at a plane perpendicular to plane of the first radiation portion. The ground portion is grounded. The connection portion connects to one side of the first radiation portion. The second radiation portion connects to one side of the connection portion away from the first radiation portion. The feed portion is electrically connected to the connection portion and the second radiation portion for feeding current and signals to the antenna structure.

16 Claims, 6 Drawing Sheets

200

200

SINGLE ANTENNA STRUCTURE CAPABLE OF OPERATING IN MULTIPLE BAND WIDTHS

FIELD

The subject matter herein generally relates to wireless communications and an antenna structure.

BACKGROUND

With the advent of 5G, transmission speed of a mobile communication network needs to become faster to support more frequency bands. In order to save costs, it is desirable that a same antenna can be used to support more frequency bands.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
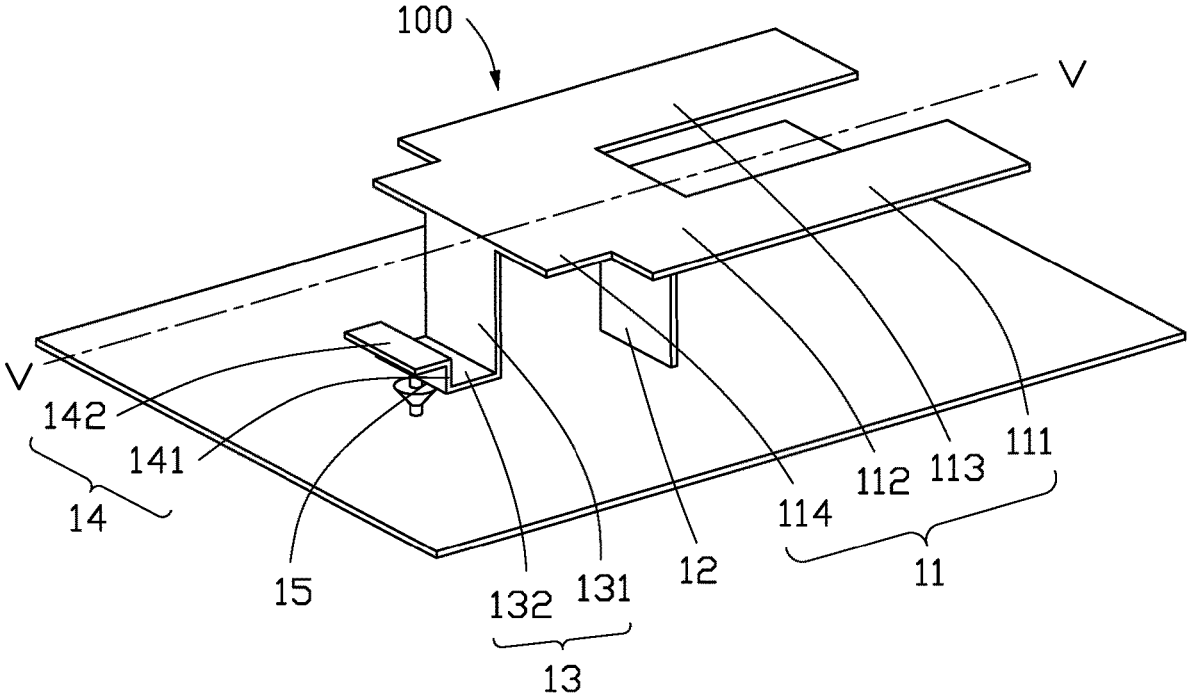
FIG. 1 is a schematic diagram of an embodiment of an antenna structure, shown from a first angle.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to a particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure.

FIG. 1 illustrates an antenna structure 100. The antenna structure 100 can be applied to a wireless communication device 200. The wireless communication device 200 can be, for example, a mobile phone, a customer premise equipment (CPE), a router, or a set top box. The antenna structure 100 can transmit and receive radio waves, to exchange wireless signals.

The antenna structure 100 can be made of a metal sheet or can be formed by means of laser direct structuring (LDS). The antenna structure 100 can be adhered to a plastic housing of the wireless communication device 200 by means of glue or the like. The antenna structure 100 includes a first radiation portion 11, a ground portion 12, a connection portion 13, a second radiation portion 14, and a feed portion 15. In this embodiment, the first radiation portion 11, the ground portion 12, the connection portion 13, and the second radiation portion 14 are all metallic sheets.

The first radiation portion 11 is substantially U-shaped. The first radiation portion 11 includes a first radiation section 111, a second radiation section 112, a third radiation section 113, and a fourth radiation section 114. In this embodiment, the first radiation section 111, the second radiation section 112, the third radiation section 113, and the fourth radiation section 114 are coplanar.

The first radiation section 111 is substantially an elongated sheet. The second radiation section 112 is substantially a strip. The second radiation section 112 is perpendicularly connected to one end of the first radiation section 111. The third radiation section 113 is substantially an elongated sheet. One end of the third radiation section 113 is perpendicularly connected to one end of the second radiation section 112 away from the first radiation section 111. Another end of the third radiation section 113 extends along a direction parallel to the first radiation section 111. The first and the third radiation sections 111, 113 are positioned parallel to each other and form a U-shaped structure with the second radiation section 112. The fourth radiation section 114 is substantially a strip. The fourth radiation section 114 is connected to one side of the second radiation section 112 away from the first and third radiation sections 111, 113.

In this embodiment, the fourth radiation section 114 is shorter than the second radiation section 112. A length of the first radiation section 111 is the same as the length of the third radiation section 113. The first radiation section 111 is longer than the second radiation section 112. Widths of the first to fourth radiation sections 111-114 are substantially the same.

The ground portion 12 is entirely positioned in a plane perpendicular to the plane of the first radiation portion 11. The ground portion 12 is substantially an elongated sheet. One end of the ground portion 12 is perpendicularly connected to the second radiation section 112. Another end of the ground portion 12 extends away from the first radiation portion 11. The ground portion 12 is electrically connected to a ground point 202 of a circuit board 201 of the wireless communication device 200 for grounding the antenna structure 100. The circuit board 201 is positioned in the wireless communication device 200.

In this embodiment, the first radiation portion 11 is parallel to the circuit board 201. The ground portion 12 is positioned between the first radiation portion 11 and the circuit board 201. The ground portion 12 is also positioned perpendicular to the first radiation portion 11 and the circuit board 201. That is, a plane of the first radiation portion 11 is parallel to a plane of the circuit board 201. A plane of the ground portion 12 is perpendicular to planes of the first radiation portion 11 and the circuit board 201. In this embodiment, a width of the ground portion 12 is less than a width of the fourth radiation section 114.

In this embodiment, the connection portion 13 is a substantially L-shaped. The connection portion 13 includes a first connection section 131 and a second connection section 132. The first connection section 131 is positioned at a plane parallel to a plane of the ground portion 12. One end of the first connection section 131 is perpendicularly connected to an edge of the fourth radiation section 114 away from the second radiation section 112 and extends towards the circuit board 201. The second connection section 132 is positioned at a plane parallel to the plane of the first radiation portion 11. One end of the second connection section 132 is perpendicularly connected to one end of the first connection section 131 away from the fourth radiation section 114. The other end of the second connection section 132 extends along a direction away from the ground portion 12 and parallel to the circuit board 201.

Figure 2:
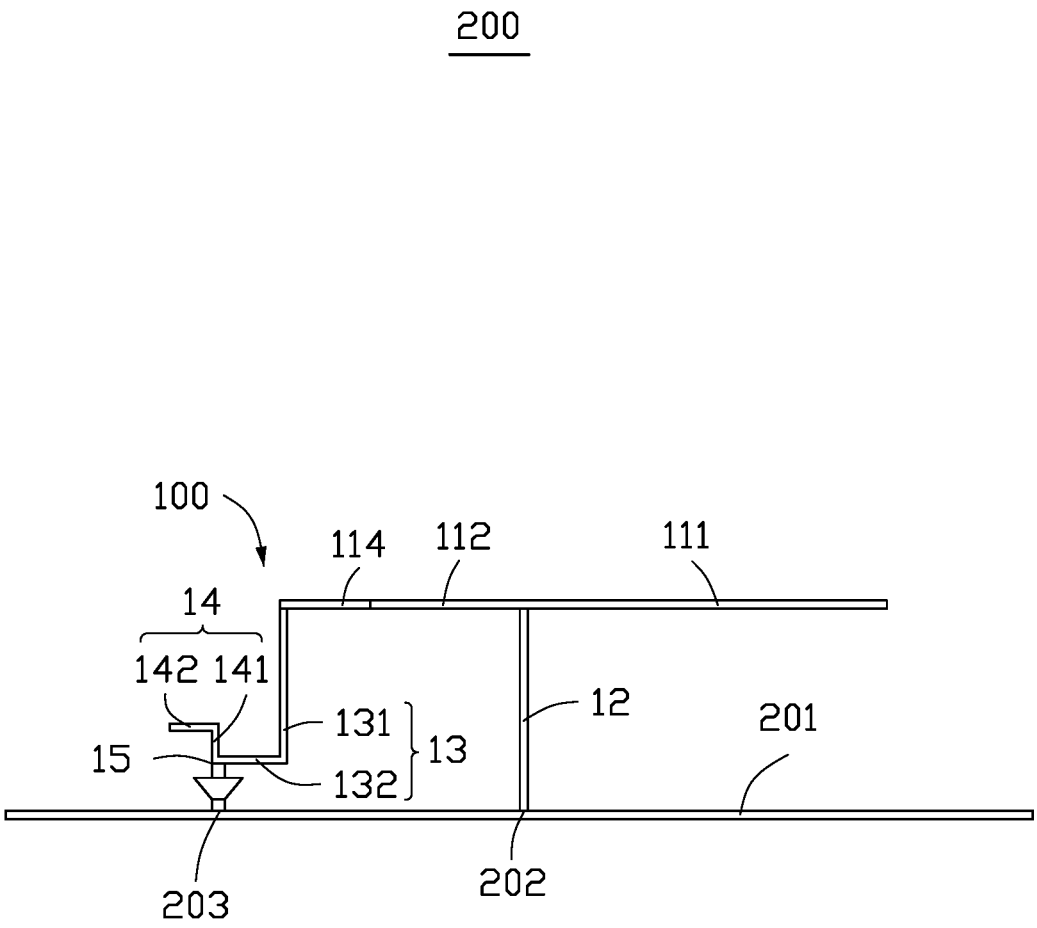
FIG. 2 is similar to FIG. 1, the antenna structure being shown from a second angle.

As illustrated in FIG. 2, in this embodiment, the first connection section 131 is shorter than the ground portion 12. The second connection section 132 is shorter than the first connection section 131 and forms an L-shaped structure with the first connection section 131. A length of the second connection section 132 is substantially same as the length of the fourth radiation section 114.

The second radiation portion 14 is substantially L-shaped. The second radiation portion 14 includes a first section 141 and a second section 142. The first section 141 is substantially rectangular. One end of the first section 141 is perpendicularly connected to one end of the second connection section 132 away from the first connection section 131. The other end of the first section 141 extends along a direction parallel to the first connection section 131 towards the first radiation portion 11. The second section 142 is substantially rectangular. One end of the second section 142 is perpendicularly connected to one end of the first section 141 away from the second connection section 132. The other end of the second section 142 extends along a direction parallel to the first radiation portion 11 and away from the ground portion 12.

In this embodiment, the first section 141 and the first connection section 131 are positioned at the ends of one side of the second connection section 132. The first section 141 and the first connection section 131 are parallel to each other and form a U-shaped structure with the second connection 132. The first section 141 is shorter than the first connection section 131. A width of the first connection portion 13 is the same as a width of the second radiation portion 14.

As illustrated in FIG. 2, the first connection section 131, the ground portion 12, and the first radiation portion 11 cooperatively form an F-shaped structure. The second connection section 132 and the second radiation portion 14 cooperatively form a stepped structure.

In this embodiment, the feed portion 15 is electrically connected to the connection portion 13 and the second radiation portion 14. The feed portion 15 is further electrically connected to a feed source for feeding current to the antenna structure 100. In detail, one end of the feed portion 15 is connected to the second connection section 132 and the first section 141. The other end of the feed portion 15 is electrically connected to a signal feed point 203 of the circuit board 201, to feed current to the antenna structure 100.

As illustrated in FIG. 1, the antenna structure 100 has a symmetrical structure. For example, the antenna structure 100 is symmetrical around the V-V line of FIG. 1. The first radiation portion 11, the ground portion 12, the connection portion 13, and the second radiation portion 14 can be formed by integral molding and stamping of conductive materials.

When the feed portion 15 feeds current, the current flows through the connection portion 13 and the first radiation portion 11, and then is grounded through the ground portion 12. A first working mode is thus excited in the first radiation portion 11 which generates a radiation signal in a first radiation frequency band.

When the feed portion 15 feeds current, a portion of the current flows through the second radiation portion 14. Another portion of the current flows through the connection portion 13 and the first radiation portion 11, and is grounded through the ground portion 12. A second working mode is thus excited in the second radiation portion 14 which generates a radiation signal in a second radiation frequency band.

In this embodiment, the first working mode is a WIFI 2.4 GHz mode. The second working mode includes a WIFI 5 GHz mode, WIFI 6 GHz mode, and a sub-7 GHz mode. The frequency of the first radiation frequency band is 2.4-2.5 GHz. The frequency of the second radiation frequency band includes 5.15-5.85 GHz, 6.1-6.8 GHz, and 7.1-7.25 GHz.

Figure 3:
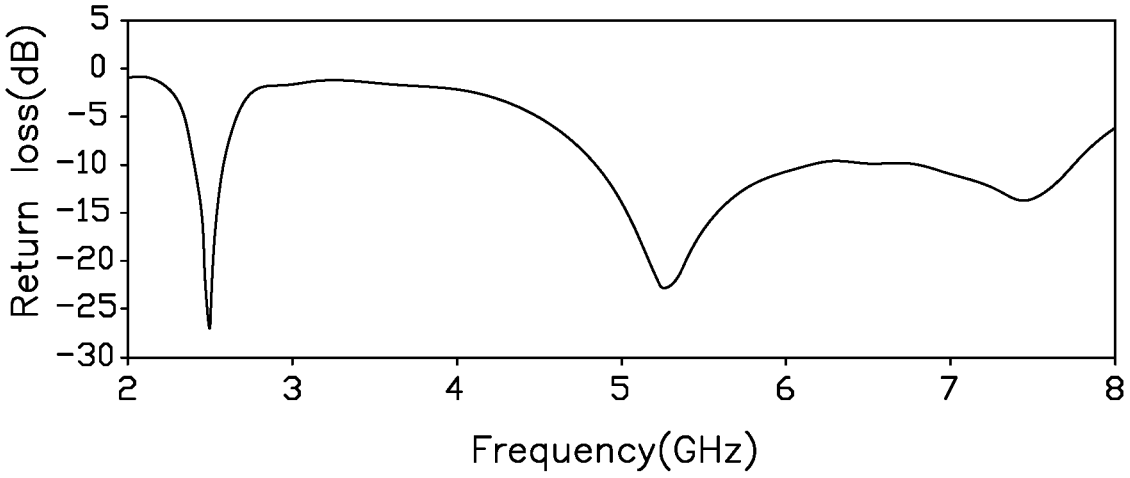
FIG. 3 is a return loss graph of the antenna structure of FIG. 1.

FIG. 3 is a graph of a return loss (Return Loss) of the antenna structure 100. As illustrated in FIG. 3, the antenna structure 100 can work in frequency bands of about 2.4-2.5 GHz, 5.15-5.85 GHz, 6.1-6.8 GHz, and 7.1-7.25 GHz. The return loss of the antenna structure 100 is low.

Figure 4:
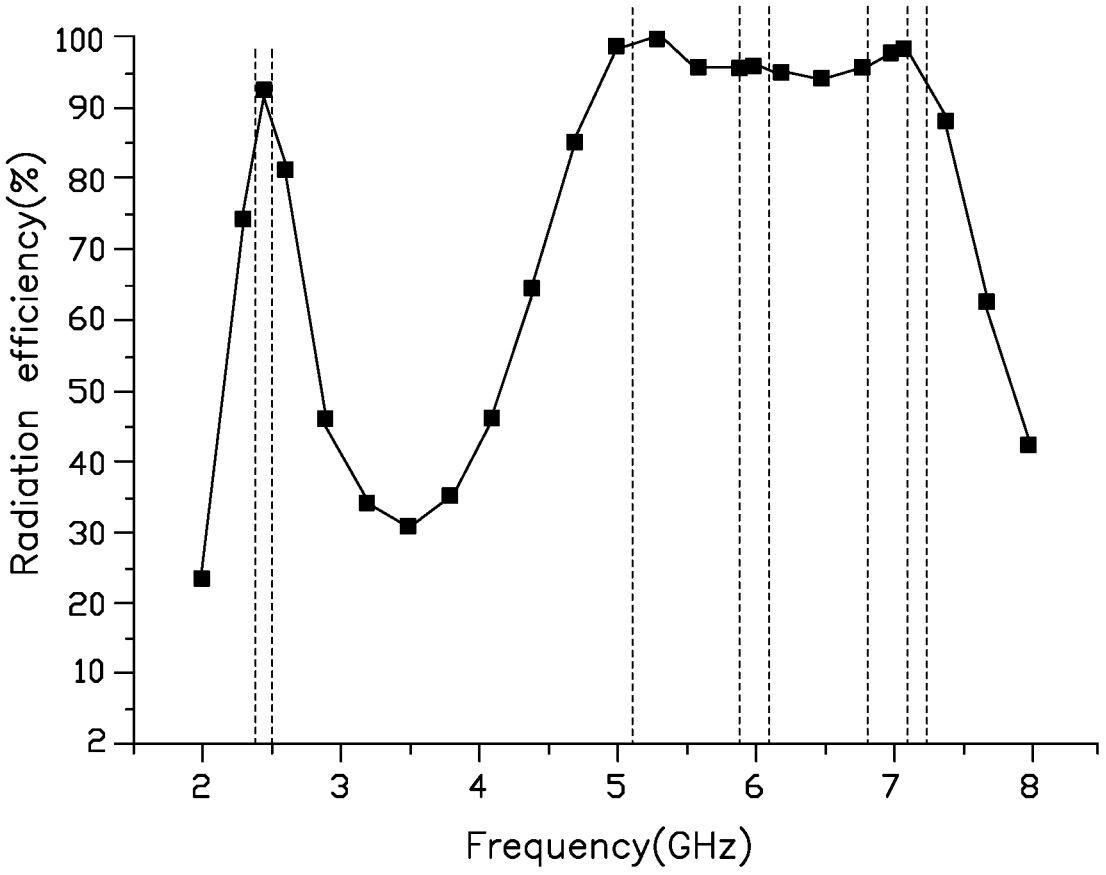
FIG. 4 is a radiation efficiency graph of the antenna structure of FIG. 1.

FIG. 4 is a graph of a radiation efficiency of the antenna structure 100. As illustrated in FIG. 4, the antenna structure 100 can work in frequency bands of about 2.4-2.5 GHz, 5.15-5.85 GHz, 6.1-6.8 GHz, and 7.1-7.25 GHz. A radiation efficiency of the antenna structure 100 can reach 90%-95%. The antenna structure 100 has a good radiation efficiency.

Figure 5:
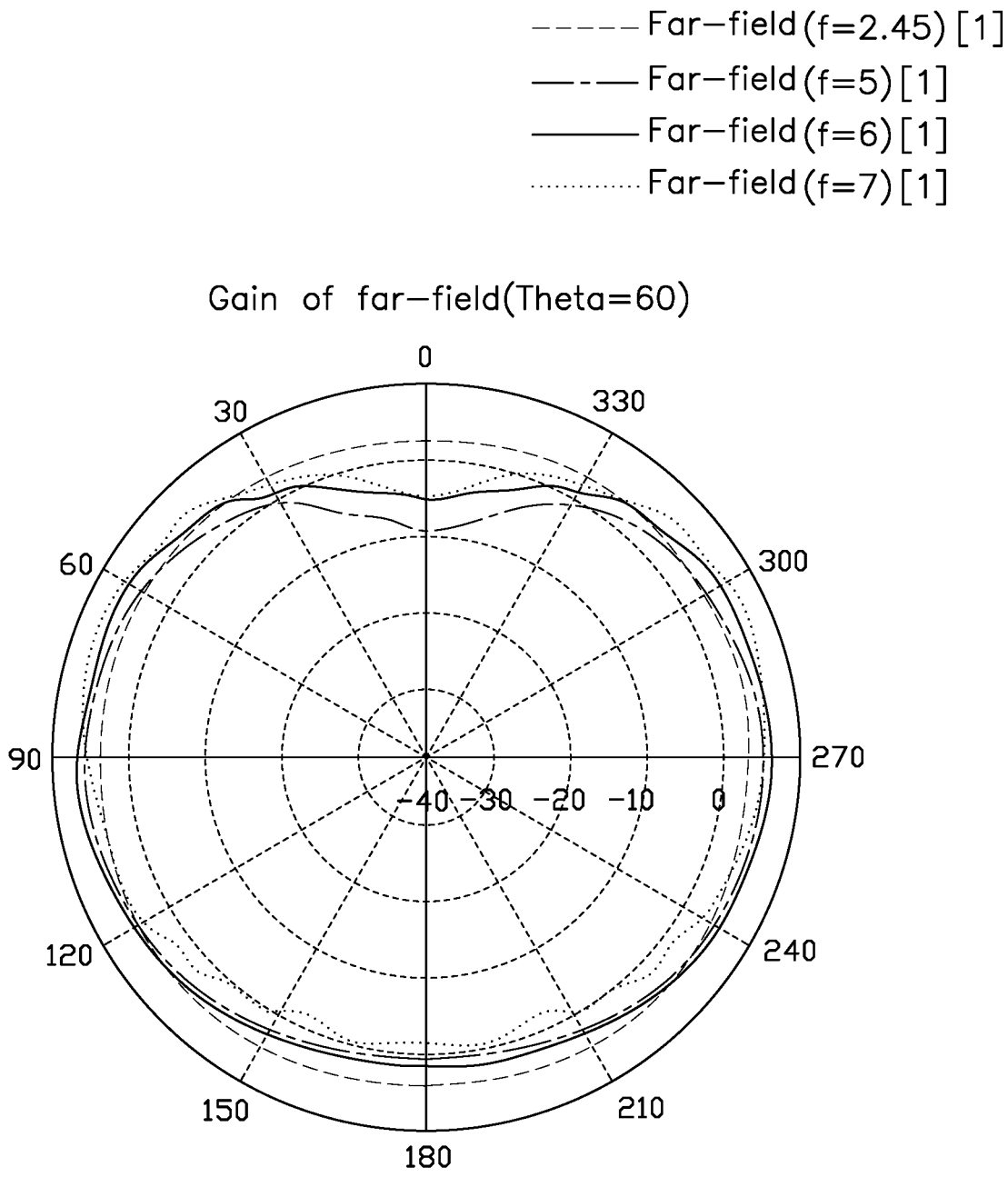
FIG. 5 is a graph of an omnidirectional radiation pattern of the antenna structure of FIG. 1.
Figure 6:
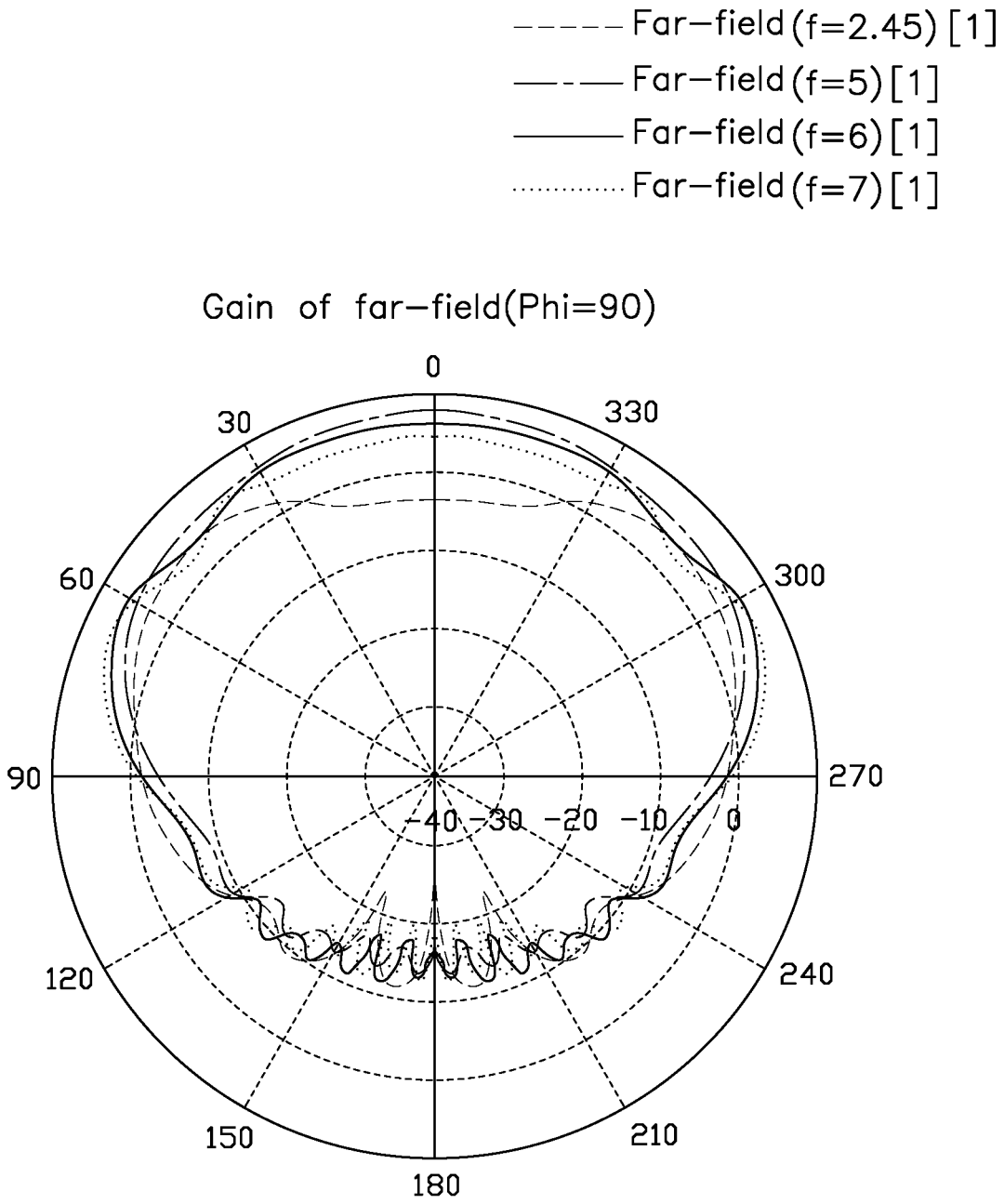
FIG. 6 is a graph of a symmetrical radiation pattern of the antenna structure of FIG. 1.

FIG. 5 is a graph of an omnidirectional radiation pattern of the antenna structure 100. FIG. 6 is a graph of a symmetrical radiation pattern of the antenna structure 100. As illustrated in FIG. 5 and FIG. 6, when the resonant frequencies of the antenna structure 100 are 2.45 GHz, 5 GHz, 6 GHz, and 7 GHz, respectively, the antenna structure 100 operates symmetrically and is omnidirectional in a horizontal direction.

The antenna structure 100 includes the first radiation portion 11 and the second radiation portion 14. The first radiation portion 11 and the second radiation portion 14 share the feed portion 15 and the ground portion 12. The feed portion 15 and the ground portion 12 are located on the sides of the antenna structure 100, thereby a bandwidth of the antenna structure 100 is expanded.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a first radiation portion;

a ground portion, the ground portion positioned at a plane perpendicular to a plane of the first radiation portion and being grounded;

a connection portion, the connection portion connecting to one side of the first radiation portion;

a second radiation portion, the second radiation portion connecting to one side of the connection portion away from the first radiation portion;

a feed portion, the feed portion electrically connected to the connection portion and the second radiation portion for feeding current and signals to the antenna structure;

wherein the first radiation portion comprises a first radiation section, a second radiation section, a third radiation section, and a fourth radiation section, the second radiation section is perpendicularly connected to one end of the first radiation section, the third radiation section is perpendicularly connected to one end of the second radiation section away from the first radiation section, and form a U-shaped structure with the first radiation section and the second radiation section, the fourth radiation section is connected to one side of the second radiation section away from the first and third radiation sections;

the connection portion comprises a first connection section and a second connection section, the first connection section is positioned at a plane parallel to a plane of the ground portion, one end of the first connection section is perpendicularly connected to an edge of the fourth radiation section away from the second radiation section, the second connection section is positioned at a plane parallel to the plane of the first radiation portion, one end of the second connection section is perpendicular connected to one end of the first connection section away from the fourth radiation section, another end of the second connection section extends along a direction away from the ground portion and parallel to the first radiation portion.

2. The antenna structure of claim 1, wherein the first radiation section, the second radiation section, the third radiation section, and the fourth radiation section are coplanar.

3. The antenna structure of claim 2, wherein the ground portion is positioned in a plane perpendicular to the plane of the first radiation portion, the ground portion is perpendicularly connected to the second radiation section and extends away from the first radiation portion.

4. The antenna structure of claim 3, wherein the second radiation portion comprises a first section and a second section, one end of the first section is perpendicularly connected to one end of the second connection section away from the first connection section, another end of the first section extends along a direction parallel to the first connection section and towards the first radiation portion, one end of the second section is perpendicularly connected to one end of the first section away from the second connection section, another end of the second section extends along a direction parallel to the first radiation portion and away from the ground portion.

5. The antenna structure of claim 4, wherein the first connection section, the ground portion, and the first radiation portion cooperatively form an F-shaped structure, the second connection section and the second radiation portion cooperatively form a stepped structure, the first connection section, the second connection section, and the first section cooperatively form a U-shaped structure.

6. The antenna structure of claim 4, wherein the feed portion is electrically connected to the second connection section and the first section.

7. The antenna structure of claim 4, wherein a plane of the first connection, a plane of the first section, and a plane of the ground portion are parallel, a plane of the second connection, a plane of the second section, and a plane of the first radiation portion are parallel.

8. The antenna structure of claim 1, wherein the first radiation portion, the connection portion, the ground portion, and the second radiation portion form a symmetrical structure.

9. A wireless communication device, comprising:

a circuit board, the circuit board comprising a feed point and a ground point;

an antenna structure, the antenna structure comprising:

a first radiation portion;

a ground portion, the ground portion positioned at a plane perpendicular to a plane of the first radiation portion and electrically connected to the ground point to be grounded;

a connection portion, the connection portion connecting to one side of the first radiation portion;

a second radiation portion, the second radiation portion connecting to one side of the connection portion away from the first radiation portion;

a feed portion, one end of the feed portion electrically connected to the connection portion and the second radiation portion, another end of the feed portion electrically connected to the feed point for feeding current and signals to the antenna structures;

wherein the first radiation portion comprises a first radiation section, a second radiation section, a third radiation section, and a fourth radiation section, the second radiation section is perpendicularly connected to one end of the first radiation section, the third radiation section is perpendicularly connected to one end of the second radiation section away from the first radiation section, and form a U-shaped structure with the first radiation section and the second radiation section, the fourth radiation section is connected to one side of the second radiation section away from the first and third radiation sections;

the connection portion comprises a first connection section and a second connection section, the first connection section is positioned at a plane parallel to a plane of the ground portion, one end of the first connection section is perpendicularly connected to an edge of the fourth radiation section away from the second radiation section, the second connection section is positioned at a plane parallel to the plane of the first radiation portion, one end of the second connection section is perpendicular connected to one end of the first connection section away from the fourth radiation section, another end of the second connection section extends along a direction away from the ground portion and parallel to the first radiation portion.

10. The wireless communication device of claim 9, wherein the first radiation section, the second radiation section, the third radiation section, and the fourth radiation section are coplanar.

11. The wireless communication device of claim 10, wherein the ground portion is positioned in a plane perpendicular to the plane of the first radiation portion, the ground portion is perpendicularly connected to the second radiation section and extends away from the first radiation portion.

12. The wireless communication device of claim 11, wherein the second radiation portion comprises a first section and a second section, one end of the first section is perpendicularly connected to one end of the second connection section away from the first connection section, another end of the first section extends along a direction parallel to the first connection section and towards the first radiation portion, one end of the second section is perpendicularly connected to one end of the first section away from the second connection section, another end of the second section extends along a direction parallel to the first radiation portion and away from the ground portion.

13. The wireless communication device of claim 12, wherein the first connection section, the ground portion, and the first radiation portion cooperatively form an F-shaped structure, the second connection section and the second radiation portion cooperatively form a stepped structure, the first connection section, the second connection section, and the first section cooperatively form a U-shaped structure.

14. The wireless communication device of claim 12, wherein the feed portion is electrically connected to the second connection section and the first section.

15. The wireless communication device of claim 12, wherein a plane of the first connection, a plane of the first section, and a plane of the ground portion are parallel, a plane of the second connection, a plane of the second section, and a plane of the first radiation portion are parallel.

16. The wireless communication device of claim 9, wherein the first radiation portion, the connection portion, the ground portion, and the second radiation portion form a symmetrical structure.

* * * * *